US008590704B2

(12) United States Patent
Koenig et al.

(10) Patent No.: US 8,590,704 B2
(45) Date of Patent: Nov. 26, 2013

(54) STACKABLE CONTAINER ASSEMBLY WITH RECIPROCAL LOCKING OF THE STACKED CONTAINERS

(75) Inventors: Andreas Koenig, Leipheim (DE); Raimund Schaffer, Ulm (DE); Timo Kuhls, Stuttgart (DE); Lutz Wolle, Burlafingen (DE)

(73) Assignee: TTS Tooltechnic Systems AG & Co KG, Wendlingen (DE)

( * ) Notice: Subject to any disclaimer, the term of this patent is extended or adjusted under 35 U.S.C. 154(b) by 172 days.

(21) Appl. No.: 13/119,573

(22) PCT Filed: Jun. 29, 2009

(86) PCT No.: PCT/EP2009/004670

§ 371 (c)(1), (2), (4) Date: Mar. 17, 2011

(87) PCT Pub. No.: WO2011/000387

PCT Pub. Date: Jan. 6, 2011

(65) Prior Publication Data

US 2011/0168599 A1 Jul. 14, 2011

(51) Int. Cl.
*B65D 21/00* (2006.01)

(52) U.S. Cl.
USPC ..... 206/508; 206/509; 206/511

(58) Field of Classification Search
USPC ..... 206/203, 508, 509, 511, 512; 220/23.83, 23.6, 380, 752, 761, 764, 220/768, 770, 772, 781; 292/1, 101, 111, 292/114, 146, 150, 153, 240, 4, 56, 98; 70/101, DIG. 65, 66, 78
See application file for complete search history.

(56) References Cited

U.S. PATENT DOCUMENTS

| | | | | |
|---|---|---|---|---|
| 2,634,020 | A | 4/1953 | Bartholomew | |
| 3,182,856 | A * | 5/1965 | Goltz | 206/509 |
| 3,387,732 | A | 6/1968 | Jellies | |
| 3,581,928 | A | 6/1971 | St. Amand | |
| 4,351,448 | A | 9/1982 | Ingersoll et al. | |
| 5,353,948 | A | 10/1994 | Lanoue et al. | |

(Continued)

FOREIGN PATENT DOCUMENTS

| | | |
|---|---|---|
| BE | 378243 | 1/1981 |
| DE | 4201264 | 7/1993 |

(Continued)

*Primary Examiner* — J. Gregory Pickett
*Assistant Examiner* — Kaushikkumar Desa
(74) *Attorney, Agent, or Firm* — Hoffman & Baron, LLP

(57) ABSTRACT

It is a matter of a container assembly with at least one stackable container (1) which has a first engaging structure (48) on its top side (19) and a second engaging structure (49) on its underside (18). The engaging structures (48, 49) are so matched to one another that, when two containers (1) are stacked together, they engage in one another in such a way that the containers are secured against shifting relative to one another at right-angles to the stacking direction and at the same time the upper container is prevented from lifting at least in certain areas. The first engaging structure (48) consists of engaging recesses (54) and the second engaging structure (49) of engaging projections (55). Feet (57) provided on the underside (18) of the container (1) are designed as elements of the second engaging structure (49) and are able to engage the first engaging structure (48) from the rear, to prevent lifting of the upper container at least in certain areas.

33 Claims, 8 Drawing Sheets

(56) References Cited

U.S. PATENT DOCUMENTS

| | | | |
|---|---|---|---|
| 5,469,961 | A | 11/1995 | Chang |
| 5,606,820 | A | 3/1997 | Suddeth |
| 5,699,925 | A | 12/1997 | Petruzzi |
| 5,755,180 | A | 5/1998 | Smith |
| 6,761,266 | B2 | 7/2004 | Popish |
| 6,959,507 | B2 | 11/2005 | Bazany et al. |
| 7,246,718 | B2 | 7/2007 | Einav et al. |
| 2003/0155267 | A1 | 8/2003 | Mercier et al. |
| 2005/0224494 | A1 | 10/2005 | Heinrichs et al. |
| 2008/0308641 | A1 | 12/2008 | Finn |
| 2009/0139892 | A1 | 6/2009 | Vovan et al. |
| 2009/0178989 | A1 | 7/2009 | Accuardi |
| 2009/0236255 | A1 | 9/2009 | Piacenza et al. |

FOREIGN PATENT DOCUMENTS

| | | |
|---|---|---|
| DE | 4409411 | 9/1995 |
| DE | 29922447 | 5/2000 |
| DE | 20104892 | 10/2001 |
| DE | 20112393 | 11/2001 |
| DE | 20119308 | 3/2002 |
| DE | 20319100 | 4/2004 |
| DE | 102007032382 | 1/2008 |
| EP | 0043540 | 1/1982 |
| EP | 0555533 | 8/1994 |
| EP | 0997234 | 5/2000 |
| EP | 1059240 | 12/2000 |
| EP | 1059240 | 2/2003 |
| EP | 1516703 | 3/2005 |
| EP | 1752262 | 2/2007 |
| EP | 2020188 | 2/2009 |

* cited by examiner

STACKABLE CONTAINER ASSEMBLY WITH RECIPROCAL LOCKING OF THE STACKED CONTAINERS

This application claims priority based on an International Application filed under the Patent Cooperation Treaty, PCT/EP2009/004760, filed Jun. 29, 2009.

BACKGROUND OF THE INVENTION

The invention relates to a container assembly, with at least one stackable container which has a first engaging structure on its top and a second engaging structure on its underside, wherein the two engaging structures are matched to one another in such a way that, when two containers are resting on top of one another, the first engaging structure of the lower container lying on top, and the second engaging structure of the upper container lying below, engage in one another in such a way that the two containers are on the one hand secured against shifting relative to one another at right-angles to the stacking direction and on the other hand, due to rear-engaging elements of the engaging structures engaging from behind at right-angles to the stacking direction, there exists between the containers a locking which prevents lifting of the upper container from the lower container at least in certain areas.

A container assembly of this kind known from DE 44 09 411 A1 has a container in the form of a packing container which, with a sideways-oriented opening, ma be stacked vertically with others of its kind and also has means which facilitate the connection of containers resting on top of one another, to obtain a uniform, manageable container unit. These means which facilitate connection comprise amongst other things a first engaging structure located on the top and consisting of two rear hooks and two pin-like projections in the frontal area. Formed on the underside of the container is a second engaging structure made up of indentations or recesses, and so matched to the components of the first engaging structure that an upper container may be fitted on to a lower container in the course of a combined insert-and-turn process. The upper container is first of all placed at an angle, until the second engaging structure has hooked or engaged from behind with the hooks of the first engaging structure, then the front section of the upper container is lowered until, through the engagement of the projections, fixing secure from shifting is effected at right-angles to the stacking direction. The rear-engaging elements of the engaging structures comprised of hooks and their assigned recesses produce a reciprocal vertical fixing of the containers in the rear part of the containers. Corresponding fixing in the front part of the containers is effected by means of several additional connecting devices, which have coupling means in the form of rotating locking bolts and which may also be used simultaneously to hold in the closed position two side-mounted lid sides assigned to the container opening, after they have been placed on one another by suitable folding down.

A person using the container may easily be injured on the raised engaging structure exposed on the top of the container. This raised first engaging structure also obstructs the attachment of other containers which do not have a suitably matching second engaging structure. Another drawback is that, when the container is stood on an uneven surface, it cannot be stored safely due to its smooth underside, and that the lower container wall may be indented or damaged through irregularities of the floor.

Already known from EP 1 059 240 B1 is a container assembly in which stackable containers are equipped with connecting devices which have rotating locking bolts allowing vertical connection of stacked containers. The rotating locking bolts are in each case mounted rotatably on a bottom part of the container and may be rotated into a connected position reaching past a lid fitted on top and in which in each case they engage from behind an anchoring projection of the bottom part mounted above. On their undersides, the containers are equipped with raised feet which are able to dip into engaging recesses on the top of the container, so as to locate the stacked containers immovably at right-angles to the stacking direction. The feet are not involved in the vertical connection of the containers.

A similar container assembly is disclosed by EP 0 555 533 B1, in which however the coupling means of the connecting devices used for vertical interconnection are in the form of locking tabs pivotably mounted on the bottom part of the container.

SUMMARY OF THE INVENTION

The problem of the invention is to create a container assembly in which the stackable container has measures which can be implemented cost-effectively and which facilitate secure vertical connection of stacked containers and moreover safe storage of containers on a surface.

To solve this problem it is provided that the first engaging structure consists of engaging recesses located on the top side of the container, and the second engaging structure of engaging projections located on the underside of the container, while the container has distributed on its underside several downwards projecting feet which belong to the second engaging structure and form at least partly its rear-engaging elements.

Since the first engaging structure provided on the top side of the container is comprised of recesses, the risk of injury when handling the container is considerably reduced owing to the absence of upwards extending sharp-edged projections. Moreover, further containers with a complementary engaging structure may be placed on the container without difficulty, without damaging the first engaging structure or the container itself. The engaging projections cooperating with the engaging recesses are an integral part of the second engaging structure provided on the underside of the container and therefore face away from the user in normal handling of the container, so that there is no longer any risk of injury. Feet on the underside of the container allow safe storage even on uneven surfaces and without risk of damage to the container walls, while one or more of the feet directly form a rear-engaging or behind engaging element of the second engaging structure, which cooperates with the first engaging structure. One or more feet therefore have a dual function which, besides the function of storage on a surface and security against shifting when stacked, also effects a local mutual locking of stacked containers in the direction of stacking.

Advantageous developments of the invention are set out in the dependent claims.

Expediently the second engaging structure has several feet, with one or more of these feet forming a locking foot and at least one other foot forming a support foot. The locking foot functions as a rear-engaging element with a locking function in the stacking direction, while the support foot effects no such locking, serving to provide support at right-angles to the stacking direction, so that the stacked containers are secured against shifting relative to one another. Naturally the locking foot or feet may also additionally exercise such a support function serving to prevent shifting.

Preferably the second engaging structure has at least two locking feet, spaced apart from one another, which in the stacked state of two containers are able to make locking engagement in each case in a separate or a jointly assigned engaging recess of the first engaging structure. Advantageous in this connection is the provision of an additional locking strip, which also forms a rear-engaging element and extends between the two locking feet, while also being able to engage in an engaging recess of the first engaging contour. Through this measure, the load-bearing force to be transmitted vertically by the engaging structures cooperating together is distributed over a relatively large surface, which increases the specific loading and therefore also the resistance to wear. The locking strip may be made as one-piece together with the two locking feet, and expediently has a lower height than these locking feet, so that the latter may continue to be placed at specific points on the ground.

To engage behind the first engaging structure, each locking foot expediently has a wedge-shaped, profiled rear-engaging section, which in particular is so oriented that it faces away from the additionally provided support foot or feet. An opposite orientation would however also be conceivable.

For interaction with the locking feet, the first engaging contour expediently has at least one locking engaging recess which has a relief-cut cross-section due to the fact that it has on its edge a rear-engaging projection aligned at right-angles to the stacking direction and which may be engaged from behind with a locking effect by a locking foot dipping into the locking engaging recess.

The locking engaging recess may easily be designed so that, with the rear-engaging projection assigned to it, all locking feet and also any locking strip provided are able to interact. In this way it is possible to realise at least locking engaging recess preferably elongated in shape, which acts in the manner of a reinforcing bead and lends the container wall great structural stiffness.

The support engaging recesses which serve to accommodate the support feet are expediently provided at the side with an oblique sliding surface which assists the dipping of the assigned support foot and in this way undertakes a centering function in the stacking of two containers. Corresponding sliding surfaces may if required also provided on the locking engaging recess or recesses.

It is of advantage if the container has a carrying handle, accessible from the upper side, for easy transport. This carrying handle may expediently be swiveled into an out-of-use position on the top of the container, so that it comes to lie recessed in a locating recess of the container. In this way, the stacking of the containers is not impaired by the carrying handle, and no shaping on the underside of the container is required. In this connection it is especially advantageous if the locating recess is at the same time the engaging recess of the first engaging structure and expediently forms a locking engaging recess with which the rear-engaging elements of the second engaging contour can make locking engagement.

At least one locking engaging recess may be made with dimensions such that it also forms a handgrip recess which may be used to carry the container, independently of any additional swiveling carrying handle provided. The handgrip recess may be used in particular when the container is to be carried separately, and has a low overall height, similar to the dimensions of a briefcase, so that it may be transported in an upright position, in which the top of the container equipped with the handgrip recess faces to the side.

The first and second engaging structures may be altogether so designed that, merely when they are engaged with one another, the upper container in its totality is prevented from lifting from the lower container. This may be achieved for example through a suitable distribution of the feet which serve as rear-engaging elements. Since, however, in the case of such a design, it is generally necessary, to produce the locking engagement, firstly to place the containers on top of one another, and then in the stacked condition to shift them relative to one another, which involves a certain heaviness in movement, a design is preferred in which, through the rear-engaging elements of the engaging structures, only a partial area of the stacked containers is locked in the direction of stacking. During placing or removal the upper container may then be pivoted vertically around the locking area thereby defined. So that the stacked containers may then be locked together completely and unable to be lifted from one another, at least one additional connecting device is provided, which acts in a releasable manner between the areas of the containers which may be pivoted relative to one another, so that through actuation of the connecting device or devices, the vertical connection may be finally completed or also released again.

As a theoretical pivot axis for the relative ability to swivel of two containers to be connected, the locking area defined by the engagement of the feet acting as rear-engaging elements and the assigned first engaging contour may be used. Expediently the arrangement made here is such that the pivot axis runs parallel to the rear of the container, whereby it is also in particular so arranged that it is off-center when the container is viewed from above, i.e. it is located closer to the rear side. The vertically swiveling area is therefore the front section of the container.

In an expedient embodiment, the stackable container has a box- or bowl-shaped bottom part with an opening, and a lid assigned to the opening of the bottom part and movable relative to the bottom part for either opening or closing the opening. The lid may in principle be made without any permanent connection to the bottom part so that, when not in use, it may be removed completely. More expedient however is a design in which the lid is mounted pivotably on the bottom part, whereby the pivotable mounting is effected expediently in the area of the rear side. Here the first engaging structure is provided expediently on the top side of the lid, and the second engaging structure on the underside of the bottom part.

In the case of a container comprising a bottom part and a lid, the engaging structures may also be so designed that they interlock the stacked containers only in certain areas, and another area of the upper container is in principle able to swivel vertically relative to the lower container. The connecting device or devices provided in this case to connect the vertically swiveling areas of the containers expediently have a coupling means, mounted movably on the lid of the container, which is movable relative to the lid into a connected position in which, to obtain the interconnected container unit, it is simultaneously in connecting engagement with the bottom parts of the lower and upper container.

Such a design has the advantage that the bearing means ensuring mobility of the coupling means are relieved when connecting engagement is made since, through the connecting engagement the two bottom parts of the containers to be coupled together are directly connected to one another by the coupling means. The bearing means are therefore not stressed or else only insignificantly by the loading force to be transmitted between the connected containers, and need no special reinforcement, so that they may be manufactured cost-effectively.

The coupling means is expediently in the form of rotating locking bolts mounted rotatably on the lid and which, in the connected position, is in connecting engagement with anchoring means fitted to the bottom part. Thus, with a simple turning movement, bottom parts of the two stacked containers may be connected to or disconnected from one another very quickly and if required also simultaneously.

The anchoring means of the bottom part are expediently divided into first anchoring means lying closer to the lid and second anchoring means lying closer to the bottom part. If two containers with matching connecting devices are stacked on top of one another, then locking with the first anchoring means of the lower bottom part and the second anchoring means of the upper bottom part may be effected by rotating the rotating locking bolt fitted to the lower lid. An advantage of the splitting of the anchoring means is that they may be attached to the bottom part with any desired vertical spread, thereby facilitating trouble-free locking of protective gas atmosphere containers irrespective of the vertical dimensions of the bottom part, i.e. locking between containers of varying overall height is possible.

For cooperation with the anchoring means, the rotating locking bolt is equipped with matching locking structures. Both the anchoring means and the locking structures are expediently bow-shaped, so that by rotating the rotating locking bolt they may be brought very easily into and out of engagement with one another. At the same time, with the connecting engagement in place, due to the curved surface the bearing loads to be transmitted are distributed over a wide surface area, meaning that the specific loading of individual components is kept extremely low. Preferably the anchoring means are in the form of projections and the locking structures are elements of slot-like recesses, but a reverse arrangement is also possible.

The connecting device or devices is or are expediently provided on an end face of the container oriented at right-angles to the stacking direction of the container, and this is the front side when the engaging structures are so designed that the assigned locking area lies in the vicinity of the rear of the container.

The connecting device or devices may advantageously have several functions. In this connection it is possible to design them so that the movable coupling means may be moved not only into the connected position but also at least into a closed position, in which they are disconnected from a container resting on the assigned container, but at the same time there is locking between the lid and the bottom part of the container concerned. In this way the lid of the container is locked in the covered position and the container may be handled separately, without other containers coupled to it. In the closed position of the coupling means it is also possible to add or remove another container to or from the container concerned.

If the coupling means is in the form of a rotating locking bolt, its rotated position in the connected position is different from that in the closed position. In this connection it is advantageous if the rotating locking bolt is provided with locking structures offset in the direction of rotation, which in the connected position and in the closed position are in connecting engagement with in each case the same anchoring means located on the bottom part. This dispenses with the need to provide anchoring means serving different purposes.

The reciprocal offset of the locking structures in the direction of rotation is in particular sufficient to allow rotation of the rotating locking bolt into at least one open position, in which the anchoring means provided on the bottom part lie between the locking structures offset from one another, so that the connecting engagement is released. In this position, the lid may then be raised from the bottom part. At the same time the conditions may be such that any upper container resting on the container is also disconnected and may be removed. As far as the container connecting function is concerned, the closed position therefore has the same effect as the open position.

As a further function, the connecting device or devices may provide the option of bringing the movable coupling means into a position described as the semi-connected position in which, while the connecting engagement with an upper container continues in force, the locking with the bottom part located below the lid is released. It is therefore possible to raise the lid without having to remove the upper container, while the upper container remains fixed to the lid.

The container assembly may have several containers differing from one another in particular in their vertical dimensions, but however equipped with similar engaging structures and connecting devices, so that they may be stacked in any desired order and releasably connected with one another to form a container unit.

BRIEF DESCRIPTION OF THE DRAWINGS

The invention is explained in detail below with the aid of the appended drawing, which shows in.

DETAILED DESCRIPTION OF THE PREFERRED EMBODIMENTS

Figure 1:
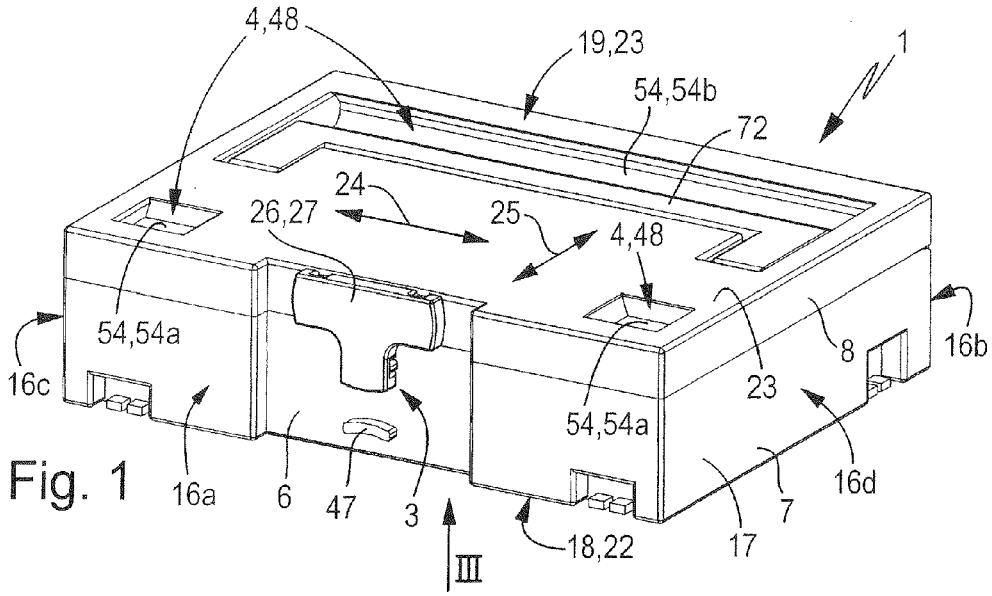
FIG. 1 a perspective view of a container according to the invention in the closed state FIG. 2 the container of FIG. 1 with the lid swung into an open position FIG. 3 a view of the container from below, looking in the direction of arrow III of FIG. 1

The container assembly depicted in FIGS. 1 to 4 comprises a container 1 which is designed to produce, by stacking on top of one another in a stacking direction 2, in particular vertical, several containers 1 of its kind, a container assembly comprising several containers 1 resting one on top of the other, as evident by way of example from FIGS. 5 to 10.

The container 1 is preferably also equipped with at least one connecting device 3 and with an engaging device 4 which allow the releasable connection to one another of cases resting on one another in such a way that the container assembly forms a container unit consisting of several connected containers 1, which may be handled and in particular transported as a unit.

The container 1 is expediently substantially rectangular in shape. Inside it has a storage space 5 to hold articles of any kind. Its body 6 is expediently divided into a box- or shell-shaped bottom part 7 and a lid 8 assigned to the opening 12 of the bottom part 7 and which may in turn also be box- or shell-shaped.

In the normal position of use of the container 1, the bottom part 7 is at the bottom and the lid 8 is on top. The present description relates to this normal position of use.

Figure 5:
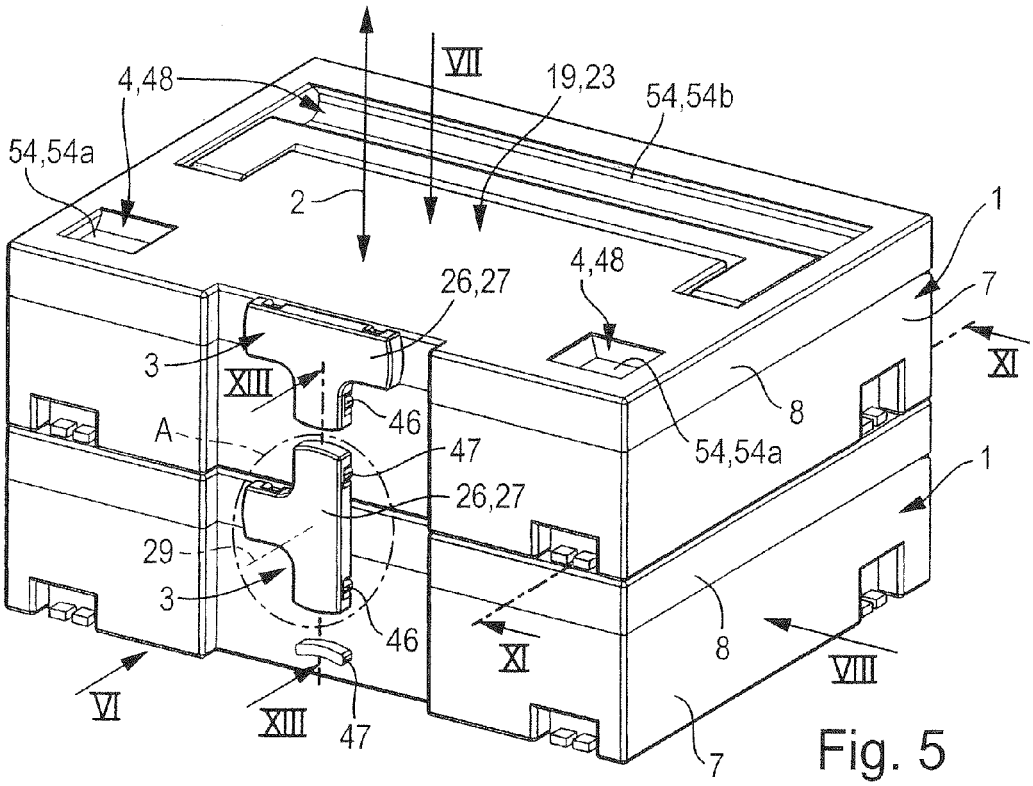
FIG. 5 a container assembly consisting of two stacked containers, connected to form a container unit FIG. 6 a front view of the assembly of FIG. 5 looking in the direction of arrow VI FIG. 7 a top view of the container assembly of FIG. 5 looking in the direction of arrow VII FIG. 8 a side view of the assembly of FIG. 5 looking in the direction of arrow VIII FIG. 9 the container assembly of FIG. 5 from a different angle of view and with the connecting means of a connecting device removed FIG. 10 the container assembly of FIG. 5 in a perspective side view, with an upper container being placed on a lower container FIG. 11 a cross-section through the container assembly along section line XI-XI of FIGS. 5 and 6 in the area of the engaging structures in engagement with one another FIG. 12 a detail view of connecting means in a rear view looking in the direction of arrow XII of FIG. 9

The lid 8 may adopt a covering position relative to the bottom part 7, as seen for example in FIGS. 1 and 5. Here it sits completely on the edge of the bottom part 7 and seals the opening 12, so that the storage space 5 is covered and inaccessible.

Figure 2:
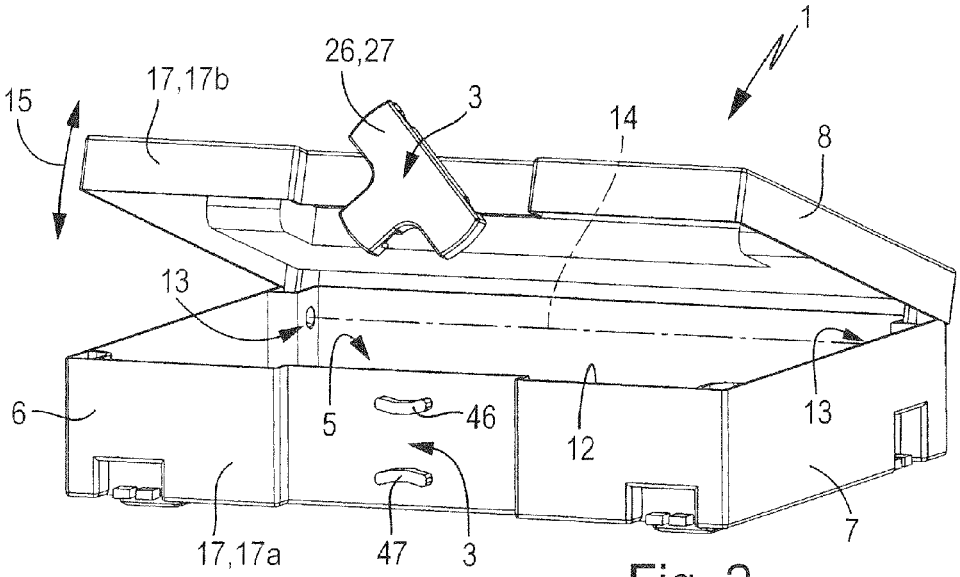
Figure 3:
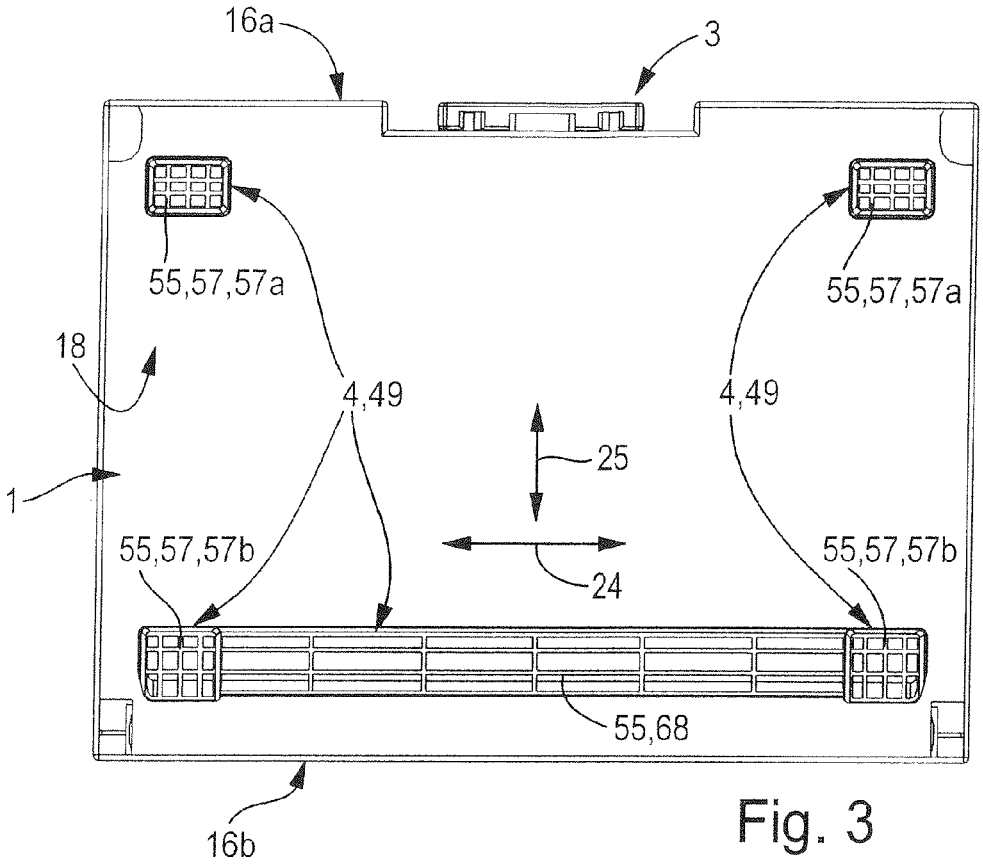
Figure 9:
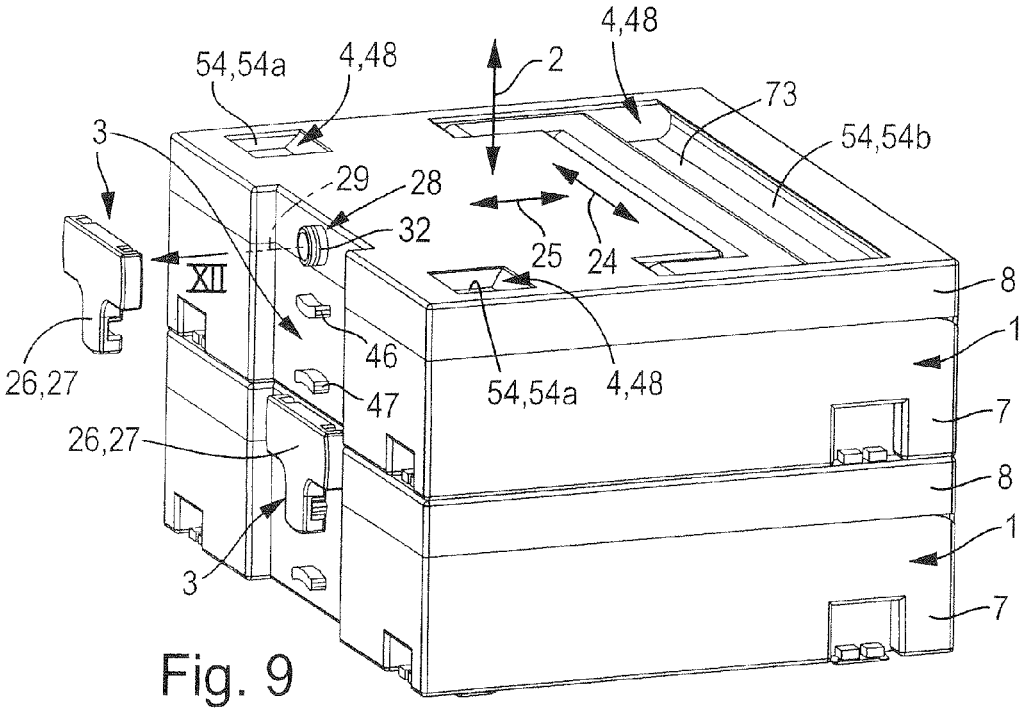

On the other hand, the lid 8 may also be moved away from the bottom part 7, into an open position seen for example in FIGS. 2 and 9, in order to free the opening 12 and make the storage space 5 accessible.

In principle, no permanently connected link is required between the bottom part 7 and the lid 8, which would allow complete removal of the lid 8 from the bottom part 7 to obtain an open position. It is however expedient to fix the two components to one another in such a way that they also represent a cohesive assembly in the open position of the lid 8. Exemplarily, this is obtained through a pivotable mounting of the lid 8 on the bottom part 7 using hinge means 13, which define a lid swivel axis 14 around which the lid 8 may be pivoted according to double arrow 15 in the vertical direction of the container 1, in order to open and close the container 1.

Based on the normal position of use, the container 1 has on its outside a front end face 16*a*, an opposite rear end face 16*b*, together with two similarly opposite side end faces 16*c*, 16*d* running between the front and rear end faces 16*a*, 16*b*. These end faces 16*a*-16*d* are part of a frame-like peripheral wall 17, which in the embodiment is divided into a peripheral wall section 17*a* belonging to the bottom part 7 and a peripheral wall section 17*b* belonging to the lid 8. With the container 1 closed, the two peripheral wall sections 17*a*, 17*b* are expediently flush with one another.

The exterior of the container 1 also has a lower outer surface described as the underside 18 and an upper outer surface described as the top side 19. The underside 18 is part of a bottom surface 22 belonging to the bottom part 7, while the top side 19 is part of a top panel 23 belonging to the lid 8. The bottom surface 22 and the top panel 23 both extend in the normal position of use in a horizontal plane, while the stacking direction 2 which coincides with the vertical direction of the container 1 is oriented at right-angles to the former.

If, as may be seen in FIGS. 5 to 19, two containers 1 are stacked one on top of the other, the lid 8 of the currently lower container 1 in the stacking direction 2 lies between the bottom part 7 of the lower container 1 and the bottom part 7 of the upper container 1 lying on top. In particular the arrangement is such that the bottom surface 22 of the upper container 1 is in direct contact with the top panel 23 of the lid 8 lying below.

The hinge means 13 are expediently so fitted that the lid swivel axis 14 is assigned to the rear end face 16*b*. To open the container 1, the lid 8 may therefore be swiveled upwards in the area of its front side.

Where the terms "front side" and "rear side" are used below, they refer to those sides of the container 1 on which the front end face 16*a* and the rear end face 16*b* are located. In what follows, "transverse direction 24" describes a direction which is at right-angles to the stacking direction 2 and at the same time parallel to the front and rear end faces 16*a*, 16*b*. A direction at right-angles to the transverse direction 24 is described as the vertical direction 25.

Figure 7:
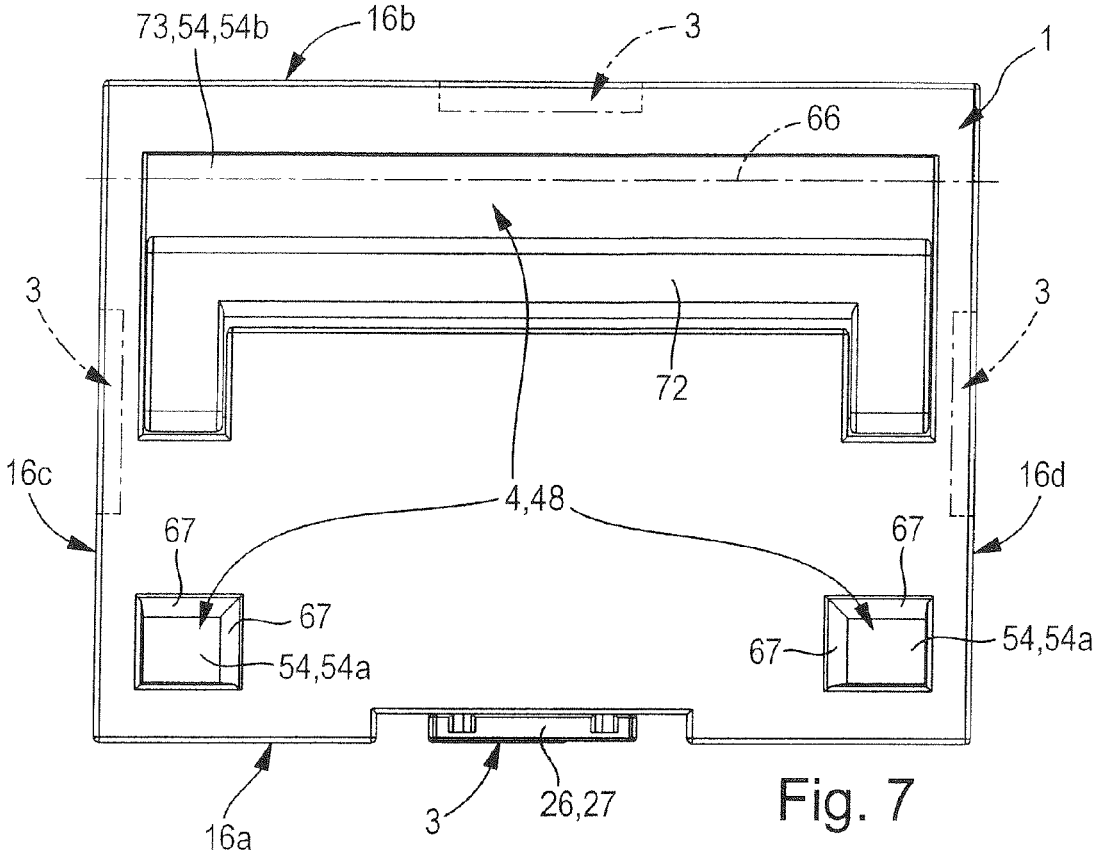
Figure 8:
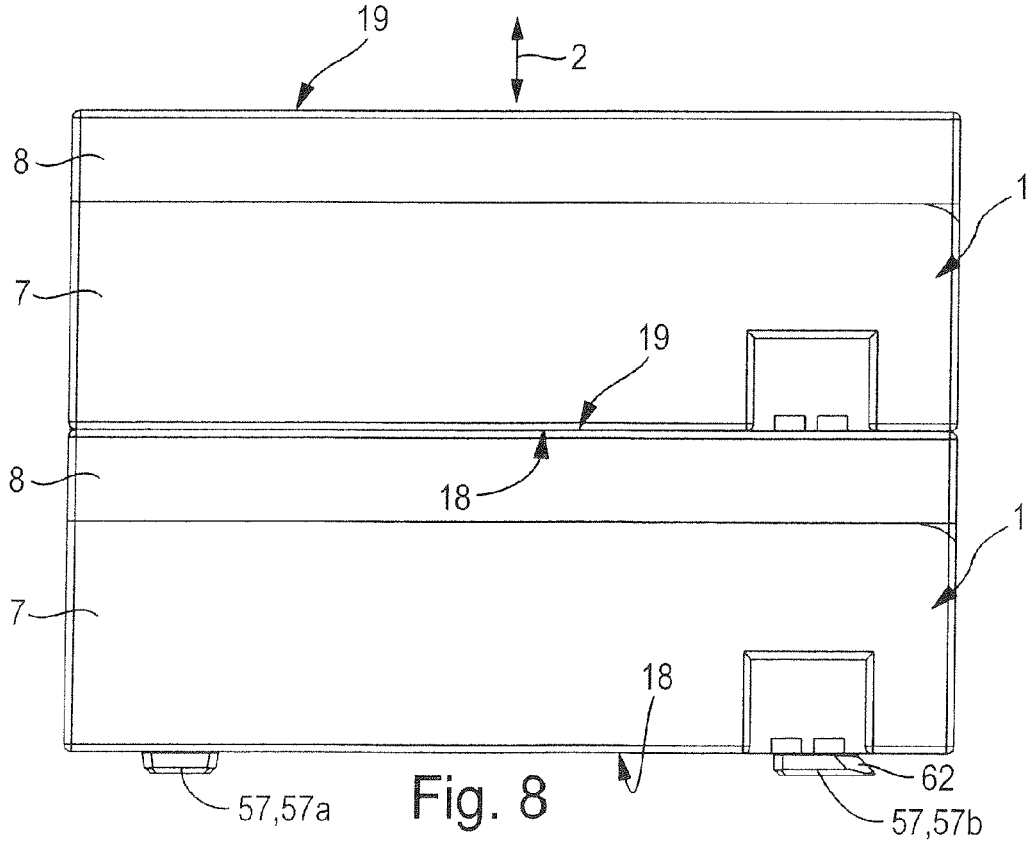

The connecting device 3 allows a releasable connection of a lower container 1 to an upper container 1 currently resting on top of it. As indicated in FIG. 7 by dot-dash lines, in each case at least one connecting device 3 could in principle be provided on several or even on all end faces 16*a*-16*d* of the container 1. Due to the additional provision of the engaging device 4, provision of the connecting device 3 in the embodiment is restricted to the front end face 16*a*, with preferably only a single connecting device 3 being provided, and placed centrally relative to the transverse direction 24, i.e. on the front end face 16*a* in the center of its width. Handling is thereby greatly simplified.

A multiple arrangement of connecting devices 3, in particular operable independently of one another, is recommended especially if the load to be transferred through the connecting process is very high and is to be distributed over several points.

Figure 6:
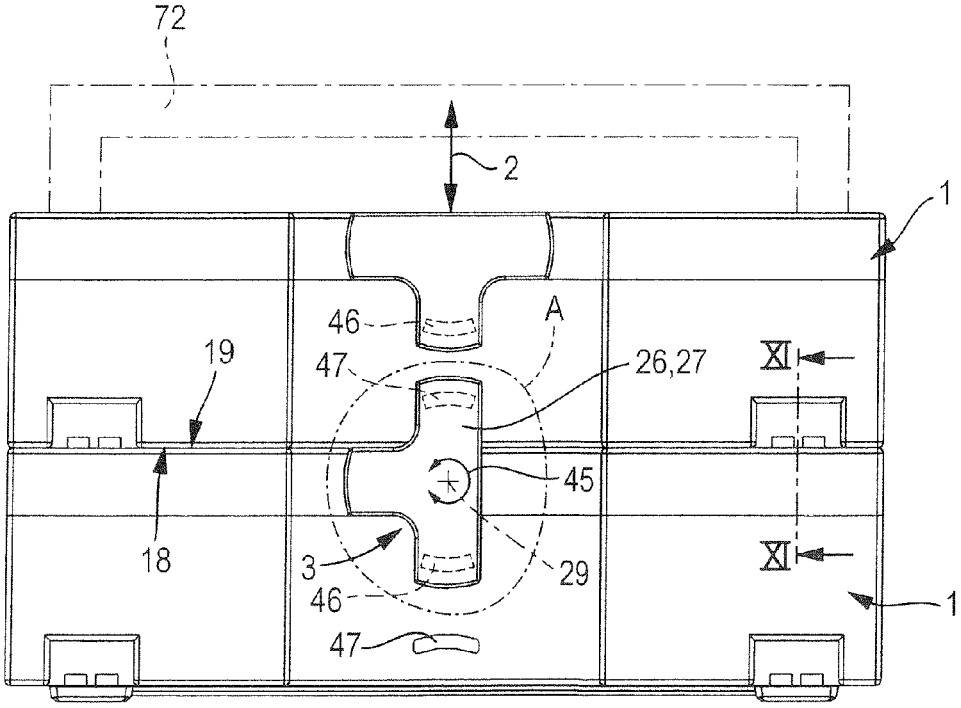
Figure 13:
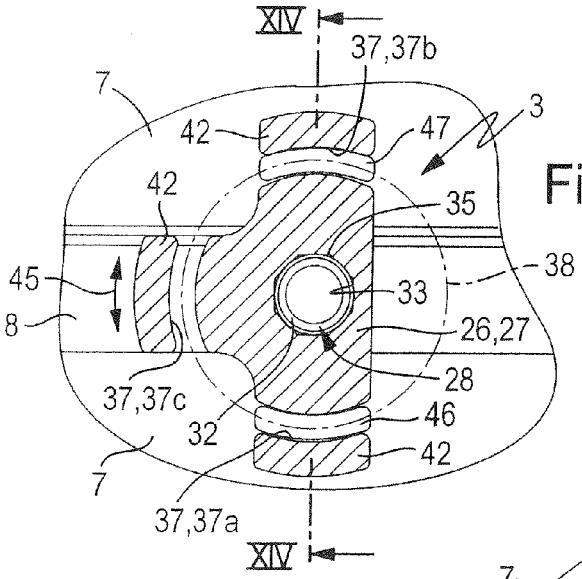
FIG. 13 the detail A bordered in FIGS. 5 and 6 of a container unit in the connected position of the connecting means, in a sectional view along section line XIII-XIII of FIGS. 5 and 14
Figure 15:
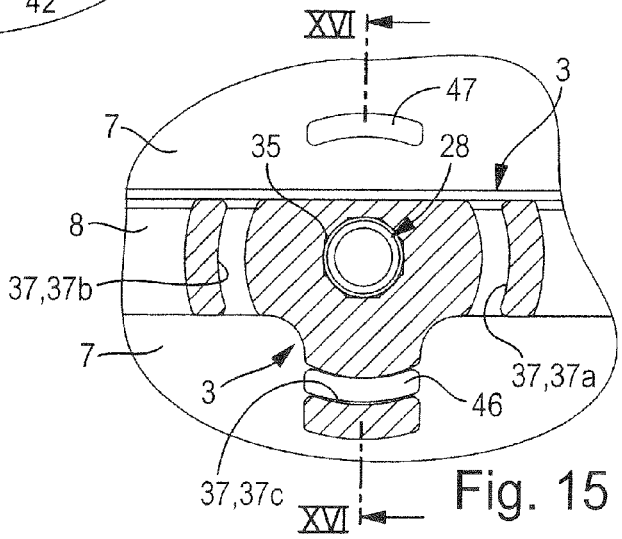
FIG. 15 the detail A of FIGS. 5 and 6 in the same sectional view as FIG. 13, with connecting means moved into the closed position and in a sectional view along section line XV-XV of FIG. 16
Figure 14:
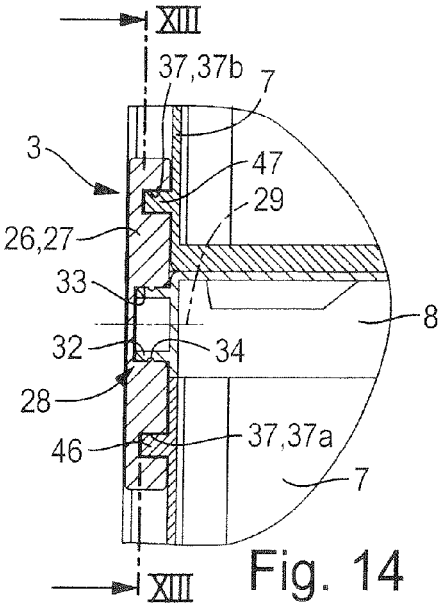
FIG. 14 the assembly of FIG. 13 in a section along section line XIV-XIV

The connecting device 3 has a connecting means 26, mounted on and movable relative to the lid 8, and movable into a connected position shown in the lower half of FIGS. 5 and 6, also in FIGS. 13 and 14. In this connected position it is simultaneously in such connecting engagement with the bottom parts 7 of both stacked containers 1 that the two bottom parts 7 may no longer be moved relative to one another in the stacking direction 2. The connecting means 26 prevents the lifting of the upper container, while in the opposite direction the fixing is effected by the reciprocal direct vertical support of the containers 1 between themselves.

Figure 12:
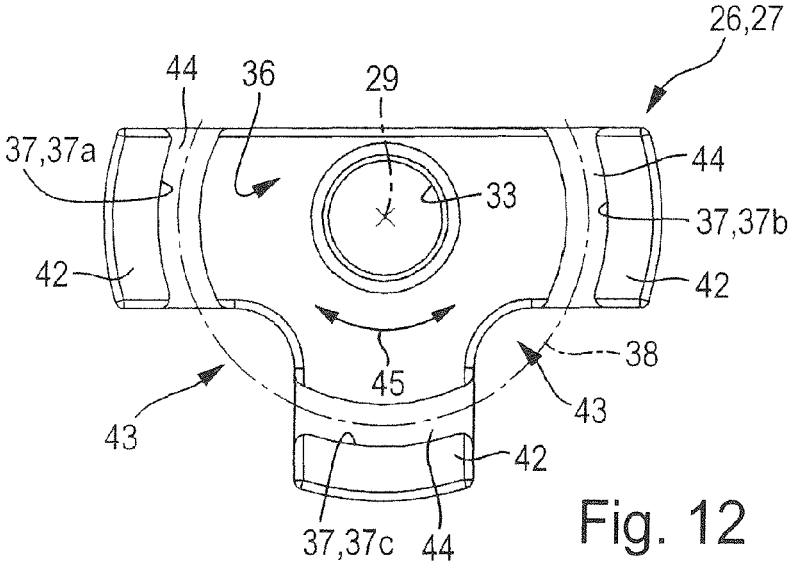

In principle one could imagine the connecting means 26 as an element with any desired and suitable degree of freedom of movement. Regarded as especially expedient, however is a design in the form of a rotating locking bolt 27, as is the case in the embodiment. FIG. 12 shows a detail view of a preferred version of the rotating locking bolt 27 seen from the rear.

Figure 16:
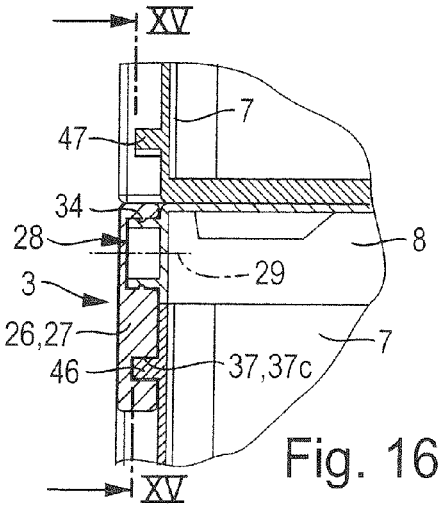
FIG. 16 the assembly of FIG. 15 in a section along section line XVI-XVI

The rotating locking bolt 27 is expediently mounted rotatably on the front end face 16*a* of the lid 8, with the rotation axis 29 defined by the assigned pivotable mounting means 28 running in particular at right-angles to the front end face 16*a*. In the embodiment the pivotable mounting means 28 consist of a pivot pin 32, for example shaped like a pipe socket and extending forwards from the front end face 16*a* of the lid 8, and a bearing recess 33 formed in the rotating locking bolt 27, which is preferably in one piece and in particular made of plastic, and by which the rotating locking bolt 27 is rotatably attached to the pivot pin 32. The axial fixing may be effected by any desired securing means, for example by latching means 34 (FIGS. 14 and 16).

As indicated in FIGS. 13, 15, 17 and 18, the pivotable mounting means 28 may be provided with indexing means 35, which may be used to locate the rotating locking bolt 27 in various preferred positions non-rotatable relative to the lid 8, in such a way that it may be rotated further by applying only slightly increased force. This may for example involve latching means. Also conceivable are indexing means 35 of the kind based on a locking principle and requiring active unlocking with the finger of one hand.

The rotating locking bolt 27 has on its rear side 36 facing the body 6 several locking structures 37 evident from FIG. 12 and arranged with radial clearance from the rotation axis 29, wherein this radial clearance is expediently identical for all locking structures 37. These locking structures 37 are distributed in the peripheral direction of the rotation axis 29 and are spaced apart from one another, but lie preferably on a common circular arc 38, the center of which lies on the rotation axis 29.

Preferably the locking structures 37 comprise at least three locking structures, designated below as first, second and third locking structures 37*a*, 37*b*, 37*c*. Of these, the first and second locking structures 37*a*, 37*b* preferably lie diametrically opposite relative to the rotation axis 29, i.e. they are located on opposite sides of the rotation axis 29. The circumferential offset of the first and second locking structures 37*a*, 37*b* with respect to the rotation axis 29 therefore amounts substantially to at least 180°. The third locking structure 37*c* is offset by 90° relative to the two aforementioned locking structures 37*a*, 37*b*.

The rotating locking bolt 27 is especially convenient to grip if it is roughly T-shaped, as depicted, in particular with three locking bolt arms 42, substantially of equal length, and extending radially outwards from the locking bolt center with the bearing recess 33. Expediently, each locking bolt arm 42 is provided with one of the locking structures 37*a*, 37*b*, 37*c*. Between the locking bolt arm 42 with the third locking structure 37*c* and each of the other two locking bolt arms 42 there is expediently a gap 43, the purpose of which will be explained below.

Preferably the locking structures 37 are comprised in each case of the radially-outwards lying outer recess flanks, facing the rotation axis 29, of a slot-like recess 44 formed in the rear of the body of the rotating locking bolt 27. Each recess 44 expediently curves along the arc 38. The outer locking flanks acting as locking structures 37 also have a correspondingly curved shape with the curve centers lying on the rotation axis 29.

If the rotating locking bolt 27 is rotated according to double arrow 45 around the rotation axis 29, the locking bolt arms 42 pivot around the rotation axis 29, whereat a locking bolt arm 42 momentarily extending upwards or downwards in the stacking direction 2 extends outwards in the corresponding direction over the lid 8. The distance between the locking structures 37 and the rotation axis 29 is therefore greater than the distance between the rotation axis 29 and the top and bottom of the lid 8.

As further components, the connecting device 3 has first and second anchoring means 46. 47, which are located on the front end face 16*a* of that bottom part 7 to which the lid 8 carrying the rotating locking bolt 27 also belongs. The two anchoring means 46, 47 are mounted in the stacking direction 2 beneath the lid 8, preferably with clearance, while in the stacking direction 2 they are expediently flush and in particular spaced apart from one another in such a way that the first anchoring means 46 are positioned closer to the lid 8 than the second anchoring means 47.

As complementary elements to the slot-like recesses 44, the anchoring means 46, 47 are each formed in the embodiment by a projection, in particular arc-shaped. The first anchoring means 46, which are therefore curved, are so arranged on the bottom part 7 that their curvature corresponds to that of the arc 38 and they are arranged exactly on this arc 38.

The curvature of the second anchoring means 47 is opposite to that of the first anchoring means 46. Consequently, the convex surfaces of the two anchoring means 46, 47 face one another. The curvature of the second anchoring means 47 is identical to that of the first anchoring means 46, while the second anchoring means 47 are so positioned with such clearance from the rotation axis 29 that the distance between the second anchoring means 47 of an upper container 1 from the rotation axis of the container 1 lying below is the same as the distance between the rotation axis 29 and the first anchoring means 46.

So, when two containers 1 rest one on top of the other, the first anchoring means 46 of the lower container 1 and the second anchoring means 47 of the upper container 1 lie together on the arc 38 (see FIG. 13).

A reverse arrangement would also be possible, to the effect that the anchoring means 46, 47 are in the form of slot-like recesses into which the anchoring structures 37 of the rotating locking bolt 27, formed by projections, are able to engage.

In principle it would also be possible to design the first and second anchoring means 46, 47 as a unit.

When two containers 1 rest one on top of the other, the rotating locking bolt 27 of the lower container 1 may be rotated into the connected position evident from FIGS. 5, 6, 13 and 14, in which the first locking structure 37*a* is in connecting engagement with the first locking means 46 of the lower bottom part 7, and there is at the same time connecting engagement between the second locking structure 37*b* located on the upwards extending locking bolt arm 42 and the second anchoring means 47 of the upper bottom part 7. A position in which the rotating locking bolt 27 is rotated through 180° brings the same result, only here the first and second locking structures 37*a*, 37*b* are transposed in respect of their interaction with the two anchoring means 46, 47.

In the connected position, the anchoring means 46, 47 are overlapped, on the sides facing in opposite directions relative to the stacking direction 2, by the first and second locking structures 37*a*, 37*b*, so that the bottom parts 7 may no longer be disconnected from one another in the stacking direction 2. Here the lid 8 of the lower container 1 may be clamped between the bottom parts 7 flanking it above and below.

Besides the connected position, the rotating locking bolt 27 may also be put into other rotary positions which meet a specific function. In this connection, the positioning is aided by the indexing means 35. A further such position is the closed position evident for example from FIGS. 1, 15 and 16, which is also present for the rotating locking bolt of the upper container 1 in FIGS. 5 to 10. The closed position differs from the connected position by a position rotated through 90°, so that the first and second locking structures 37*a*, 37*b* come to lie without effect in the area of the front end face 16*a* of the lid 8, and only the third locking structure 37*c*, located on a locking bolt arm 42 extending downwards into the closed position, is effective. This third locking structure 37*c* is in connecting engagement with the first anchoring means 46, so that the lid 8 is locked relative to the bottom part 7 and cannot be lifted. The locking force effective between the lid 8 and the bottom part 7 is here transferred on the part of the lid 8 via the pivotable mounting means 28, which however represents no further problem since only a closing force is involved, which is relatively small and places only a small load on the pivotable mounting means 28.

The design of the rotating locking bolt 27 is such that, in the closed position, it does not extend into that area in which the second anchoring means 47 of a further upper container 1 which may possibly be placed on this container are to be found. Especially advantageous is a a structure with the effect that the rotating locking bolt 27 in the closed position does not extend at all or else only slightly over the top side 19 of the lid 8.

On adoption of the closed position of the rotating locking bolt 27, a further container 1 may be placed at any time on the assigned container 1, and also removed again unimpeded.

The closed position of the rotating locking bolt 27 may therefore be used to disconnect the container unit. It may also be used for releasable locking of the lid 8, relative to the bottom part 7, of a container 1 to be used separately, so that the lid 8 is secured in the covering position. Such a situation is shown in FIG. 1.

As is clear, the locking structures 37 of the rotating locking bolt 27 always cooperate in both the connected position and also the closed position with the same first anchoring means 46 of the lower bottom part 7. The design cost is therefore relatively low.

Figure 17:
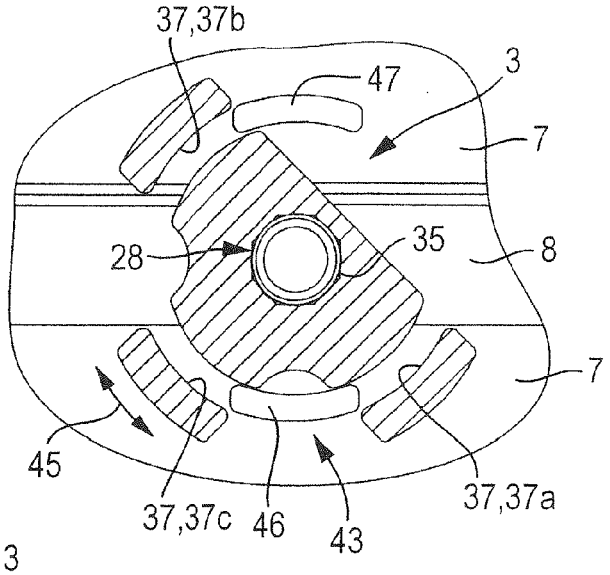
FIG. 17 the detail A of FIGS. 5 and 6 in a view comparable to FIGS. 13 and 15, with the connecting means shown in the open position FIG. 18 the detail A of FIGS. 5 and 6 in a view corresponding to FIGS. 13 and 15, with the connecting means shown in the semi-connected position FIG. 19 the container assembly of FIG. 5 in an open position of the lower container, with an upper container simultaneously connected to the lid of the lower container.

Another functional position of the rotating locking bolt 27 is shown in FIGS. 2 and 17. This involves an open position in which the locking between lid 8 and bottom part 7 is released so that the lid 8 may be swiveled up to open the container 1 as shown by arrow 15. Expediently this open position, as also the closed position explained above, simultaneously forms a release position with respect to the upper container resting on the container 1 and in which the locking engagement of the rotating locking bolt 27 is released in both the open position and also the closed position.

In the open position, the gaps 43 located between adjacent locking structures 37 acquire their importance. The width of these gaps 43 is at least as great as the width of the first anchoring means 46, while the rotating locking bolt 27 is so positioned in the open position that the gap 43 comes to lie in the area of the first anchoring means 46. In other words the first anchoring means 46 are therefore located in the gap 43, which is large enough to allow upwards swiveling of the lid 8, without this being prevented by the first anchoring means 46. In the open position, therefore, the first anchoring means 46 are entirely out of connecting engagement with any locking structures 37.

On account of the preferred symmetrical design of the rotating locking bolt 27, the latter may be put into two alternative open positions which, starting from the closed position, may be reached by rotating the rotating locking bolt 27 in one or the other direction, wherein the angle of rotation is preferably 45° in each case. If only one open position is provided, then one of the gaps 43 may be omitted.

Figure 18:
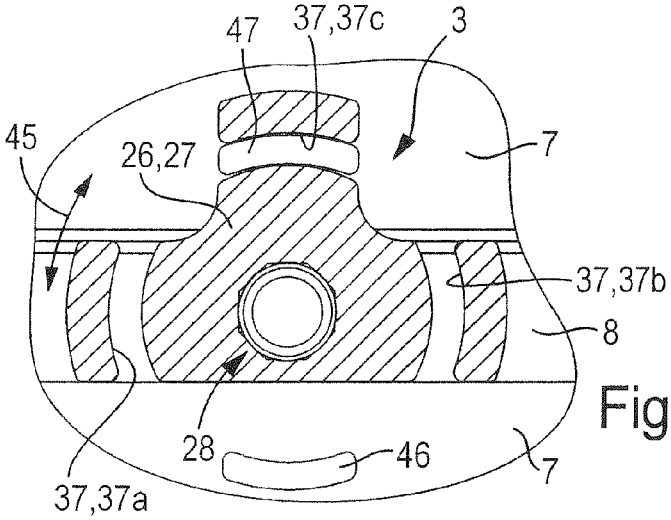

Finally, the rotating locking bolt 27 may also be brought into a functional position shown in FIG. 18 and described as the semi-connected position because, while the connecting engagement with the bottom part 7 belonging to the lid 8 is released, the connecting engagement with the bottom part 7 of the upper container 1 resting on the lower container 1 is not released. The semi-connected position is also evident once more in FIG. 19 in connection with the rotating locking bolt 27 belonging to the lower container 1.

In the embodiment, the semi-connected position is a position rotated through 90° relative to the connected position. Here the locking bolt arm 42 equipped with the third locking structures 37*c* extends upwards, in front of the front end face 16*a* of the bottom part 7 of the upper container 1. There the third locking structure 37*c* is in locking engagement with the second anchoring means 47. Relative to the first anchoring means 46, the locking engagement is cancelled, while the first and second locking structures 37*a*, 37*b* are in the same position as in the closed position according to FIG. 15, only interchanged in their orientation.

Figure 19:
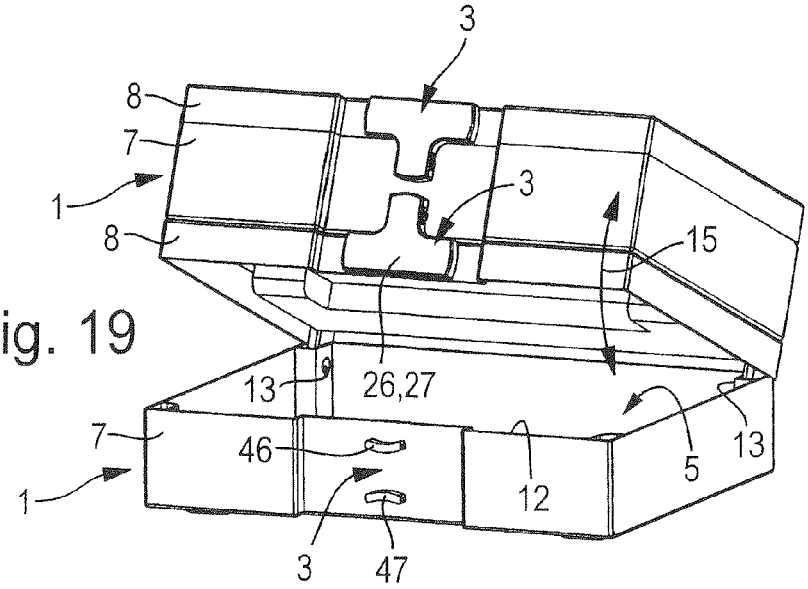

In the semi-connected position, the lid 8 which is no longer locked to the bottom part of the lower container 1 may be swiveled up as shown in FIG. 19, and specifically together with the one or more further containers 1 mounted on this lid 8, which continue(s) to be locked to the lid 8 which may be swiveled upwards in the same manner as in the case of a connected position. The container unit is therefore not disassembled, while the lower container 1 may still be opened to give access to the storage space 5.

It goes without saying that the design of the rotating locking bolt 27 may deviate from that depicted; in particular it would be possible to provide additional wall structures covering the gaps 41 at the front, so that the rotating locking bolt 27 has a more uniform external contour, for example comparable to the shape of a circle segment.

The engaging device 4 which is also present contains a first engaging structure 48 located on the top side 19 of the container 1, and a second engaging structure 49 provided on the underside 18 of the container 1. In the embodiment, the first engaging structure 48 is located externally on the top panel 23 of the lid 8, and the second engaging structure 49 externally on the bottom surface 22 of the bottom part 7. The two engaging structures 48, 49 are so matched that, in the stacked state of two containers 1, the upwards facing first engaging structure 48 of the lower container 1 and the downwards facing second engaging structure 49 of the upper container 1 engage with one another. This reciprocal engagement has the effect that the stacked containers 1 are on the one hand supported mutually at right-angles to the stacking direction 2 and may not be displaced relative to one another. On the other hand, it is brought about that the engaging structures 48, 49 engage at least partly from behind at right-angles to the stacking direction in such a way that effective locking is provided in the stacking direction and prevents at least a vertically upwards directed lifting of at least a certain area of the upper container 1 from the lower container 1.

In practice, the engaging structures 48, 49 are preferably so designed that they prevent lifting of the rear section 52 of the upper container 1, but on the other hand allow lifting of the front section 53 of the upper container 1. This circumstance is clear from FIG. 10. So that the front section 53 is also locked, unable to be lifted, to the lower container 1, and therefore the entire upper container 1 enters into a stable connection with the lower container 1, the connecting device or devices 3, already explained in detail, is or are provided. This connecting device 3, which rests expediently in the area of the front end face 16*a*, on assuming the connected position securely holds together the upper bottom part 7 and the lower bottom part 7, with the lower lid 8 interposed, in the manner described above.

If no connecting device 3 were provided, it could also be ensured through a suitable design of the first and second engaging structures 48, 49 that, in the stacked condition of two containers, the upper container 1 may not be lifted upwards in its entirety in the stacking direction 2. However, there are benefits in terms of handling as a result of the combination of the engaging device 4 and the connecting device 3.

The first engaging structure 48 consists of a multiplicity of engaging recesses 54 formed in the top side 19 of the lid 8 and distributed over the lid surface. The second engaging structure 49 consists of several engaging projections 55, expediently arranged with the same distribution as the engaging recesses 54 and projecting downwards over the expediently at least smooth outer base area 56 of the bottom surface 22.

Several of these engaging projections 55 form feet 57, expediently distributed at points over the underside 18, wherein the embodiment has altogether four such feet 57, placed in the corner zones of the outer base area 56 of the bottom surface 22, but here with a certain clearance in each case from the end faces 16*a*-16*d*.

When used individually, each container 1 may be stored stably on a floor with the help of the feet 57. The same applies to the use of a container 1 as lower container of a stacked container assembly. The feet 57 are expediently integral with the body 6, but may also if required be attached so as to be at least partly releasable, to facilitate replacement in case of wear.

Beneath the engaging recesses 54 are two elements 54*a* which are located in the two front corner areas of the preferred rectangular top side 19. A similar arrangement would also be possible for the engaging recesses assigned to the rear feet 57, but in the embodiment an advantageous variant has been chosen in which there is a single rear engaging recess 54*b* with dimensions such that both rear feet 57 can engage in it simultaneously.

As is evident in particular from FIGS. 1, 7 and 9, the rear engaging recess 54*b* may have an elongated shape with its long side running in the transverse direction 24 and extending parallel to the rear end face 16*b*. The front engaging recesses 54*a* on the other hand are, like the assigned front feet 57, punctiform in shape and therefore have a square outline.

In the embodiment, the two front feet are pure support feet 57*a*, with an outline complementary to that of the front engaging recesses 54*a* so that, when inserted in the front engaging recesses 54*a*, they rest on the inner side walls of the front engaging recesses 54*a*. By this means, the upper container 1 may no longer be shifted on the lower container 1 at right-angles to the stacking direction 2. The structuring of the support feet 57*a* and the front engaging recesses 54*a* is however such that there is no locking in the stacking direction 2, so that the front section 53 of the upper container 1 may be lifted at any time when the connecting means 26 is in the release position.

The rear feet 57 which cooperate with the preferred single rear engaging recess 54*b* are in contrast designed as locking feet 57*b*. Their special feature is that they function as rear-engaging elements of the second engaging structure 49 and are able to engage from the rear inside the rear engaging recess 54*b* designed for locking engagement at right-angles to the stacking direction 2, so that a locking engagement preventing relative movement in the stacking direction 2 is in force. The rear engaging recess 54*b* is therefore also described below as the locking engaging recess.

If each locking foot 57*b* is assigned a separate engaging recess 54, this is also in each case in the form of a locking engaging recess.

Figure 11:
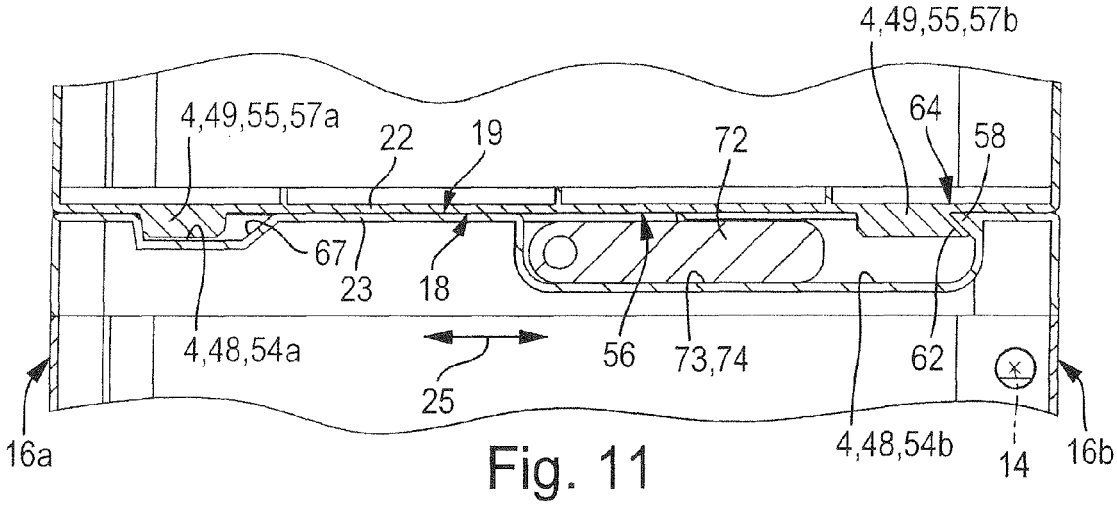

The rear engaging recess obtains its function as locking engaging recess 54*b* in particular through its design with a relief-cut cross-section, of which FIG. 11 shows an embodiment.

The locking engaging recess 54*b* which is otherwise open at the top has, at least on its edge area adjacent to the rear end face 16*b*, a rear-engaging projection 58 which is preferably rib-like and extends forwards in the vertical direction 25. This leads to the locking engaging recess 54*b* having an opening cross-section which is smaller than the base area of the floor of the recess.

On its rear side facing the rear end face 16*b*, each locking foot 57*b* has a rear-engaging section 62, expediently with a wedge-shaped profile, so that in the transition zone to the outer base area 56 of the bottom surface 22 there is a gap with a cross-section complementary to the rear-engaging projection 58 (FIG. 11).

The dimensions of the opening of the rear engaging recess 54*b* are greater in the vertical direction 25 than those of each locking foot 57*b*. The latter may therefore be inserted easily from above into the locking engaging recess 54*b*.

Figure 10:
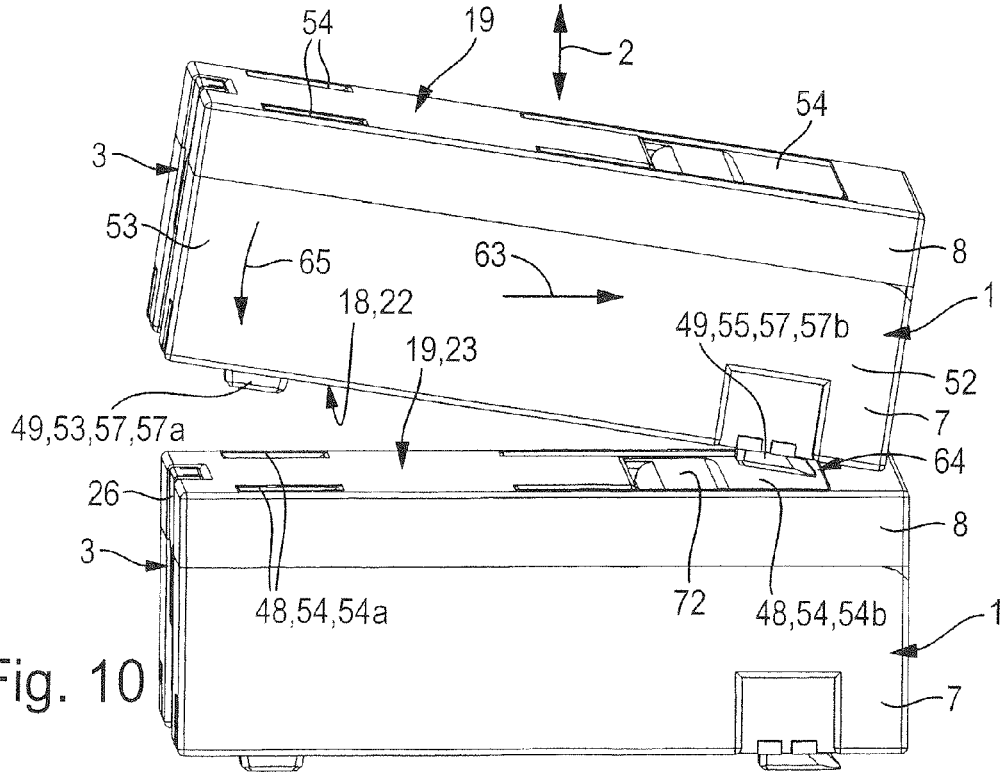

To fit an upper container 1 on a lower container 1, the upper container 1 is set down as shown in FIG. 10 in an inclined position, and with the downwards tilted rear section 52 leading, on to the top side 19 of the lower container 1, whereby the locking feet 57*b* dip into the locking engaging recess 54*b*. At the same time or afterwards, the upper container 1 is pressed or pushed downwards as indicated by arrow 63, so that the rear-engaging sections 62 come into locking engagement with the rear-engaging projection or projections 58. The area in which this locking engagement occurs may be described as the locking area 64.

In a further step, the front section 53 of the upper container 1 is swiveled downwards as shown by arrow 65, whereby the rear-engaging structures in the locking area 64 define a pivot axis 66, outlined in FIG. 7, for the aforementioned swiveling process.

On further swiveling of the front section 53 on to the top side 19 of the lower container 1, the support feet 57*a* dip into the assigned front engaging recesses 54*a* and finally complete the mutual engagement of the engaging structures 48, 49.

The rear section 52 of the upper container 1 is secured against vertical lifting by the locking engagement between the locking feet 57*b* and the locking engaging recess 54*b*. The corresponding vertical securing of the front section 53 is obtained by rotating the connecting means 26 into the connected position.

Insertion of the support feet 57*a* into the front engaging recesses 54*a* may be aided by making the side wall of the front engaging recesses 54*a* at least partly an inclined sliding surface 67. The front engaging recesses 54*a* therefore have in the area of their opening a larger cross-section than at their bottom surface, with the difference in cross-section being bridged by the inclined sliding surfaces 67. Consequently, automatic centering take place when the upper container is put on.

Figure 4:
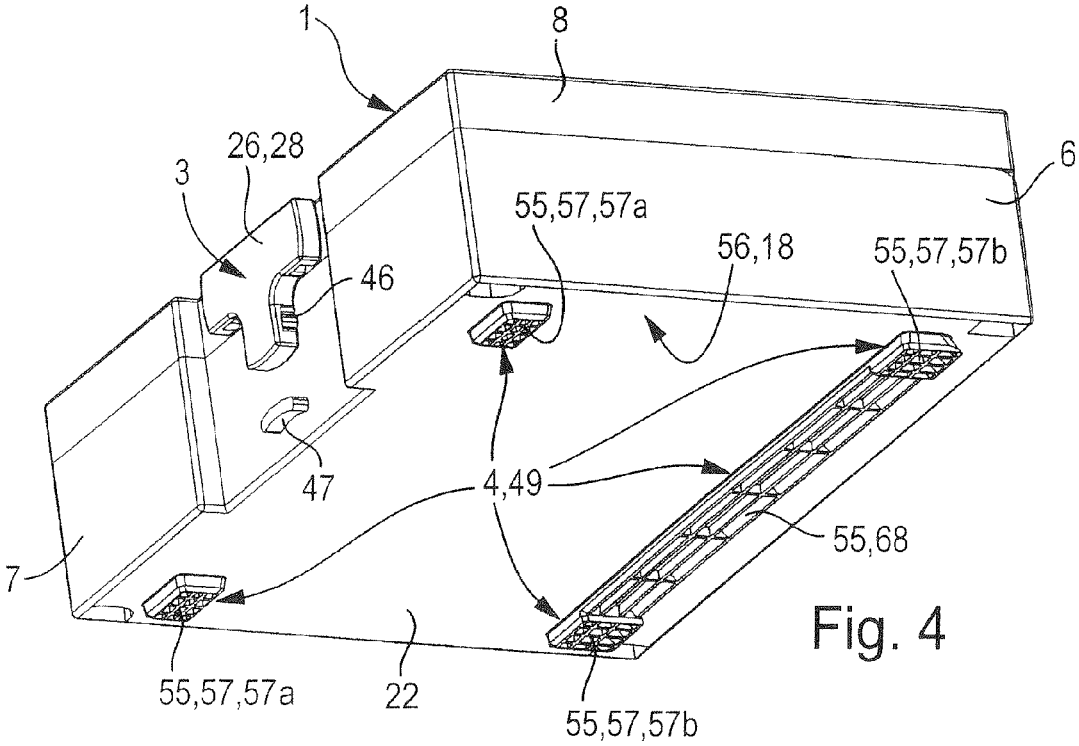
FIG. 4 an oblique view of the underside of the container

From FIG. 4 it is clear that, between the two locking feet 57*b* arranged with clearance from one another in the transverse direction 24, there may extend an additional locking strip 68 which also has a rear-engaging section 62 similar to that of the locking feet 57*b* and which expediently bridges the entire gap between the two locking feet 57*b*. This locking strip 68 also forms a rear-engaging element of the second engaging structure 49 which additionally acts on the locking feet 57*b* and increases the length of the locking contact, so that greater load-bearing capacity is obtained.

The height of the locking strip 68 measured in the stacking direction 2 is expediently less than that of the locking feet 57*b*, so that the latter extend down beyond the locking strip 68. Here, it is advantageous for the locking strip 68 and the locking feet 57*b* to be made as one-piece. It may be joined in particular integrally to the body of the bottom part 7, in a similar manner to the feet 57.

It is also quite easily possible to have a different number of feet 57 from the embodiment. For example a single strip-like locking foot 57*b* could be provided at the rear, i.e. comparable to an arrangement in which the locking strip 68 has the same height as the locking feet 57*b*.

So that the container 1 or the container unit may be transported easily, the container 1 expediently has a carrying handle 72 on its top. Expediently this carrying handle 72 is mounted on the lid. Moreover it is advantageously so designed that it may adopt either an out-of-use position, evident from the drawing, in which it is swiveled on to the top side 19, or a position of use indicated in FIG. 6, in which it is swiveled upwards and therefore extends up over the top side 19. It is preferably a bow- or U-shaped carrying handle 72.

So that the carrying handle 72 does not impede the stacking of the containers 1 a locating recess 73, open at the top, is formed in the top side 19 of the lid 8. The carrying handle 72 comes to lie in this recess when not in use. Here it is of advantage if this locating recess 73 is formed directly by the locking engaging recess 54*b* which is of matching size.

In the embodiment, the aforementioned locking engaging recess 54*b* simultaneously forms a handgrip recess 74 open on the top side 19. This gives the option of transporting a single container in an upright position rotated through 90° relative to the normal position of use, like a briefcase, and in so doing engaging from above with one hand in the handgrip recess 74, whereby the rear-engaging projection 58 may be encompassed by the fingers, so that more secure transport is possible.

Varying from the embodiment, the locking engaging feet 54*b* could also be so designed that their rear-engaging section 62 is oriented towards the front. In this case, the rear-engaging projection 58 would also be located on the edge section lying closer to the front end face 16 of at least one locking engaging recess 54*b*, and would face rearwards.

In the embodiment, the entire load-bearing force between two vertically-connected containers 1 is transferred via a three-point connection. The three connection points are comprised of locking measures in the area of the two locking feet 57*b* and the rotating locking bolt 27 fitted with clearance from the locking area 64. A certain surface force may also be transferred by the locking strip 68.

There is no problem at all in providing containers 1 of varying overall height, and which have the same connecting devices 3 and engaging devices 4 as the described container 1. By this means it is also possible to stack containers 1 of varying size without difficulty in any desired order, and combine them to form a container unit.

The combined existence of the engaging device 4 and the connecting device or devices 3 is especially advantageous, however the container may in principle also have no connecting device 3 and/or a connecting device or devices differing from the type described.

The invention claimed is:

1. A container assembly, with at least one stackable container which has a first engaging structure on its top and a second engaging structure on its underside, wherein the two engaging structures are matched to one another in such a way that, when two containers are resting on top of one another, the first engaging structure lying on top of the lower container, and the second engaging structure lying below of the upper container, engage in one another in such a way that the two containers are on the one hand secured against shifting relative to one another at right-angles to the stacking direction and on the other hand, due to rear-engaging elements of the engaging structures engaging from behind at right-angles to the stacking direction, there exists between the containers a locking which prevents lifting of the upper container from the lower container at least in certain areas, wherein the first engaging structure comprises engaging recesses located on the top side of the container, and the second engaging structure comprises engaging projections located on the underside of the container, while the container has distributed on its underside several downwards projecting feet which belong to the second engaging structure and form at least partly the rear-engaging elements of the second engaging structure, and wherein the rear-engaging elements of the two engaging structures are so arranged and designed that, when they are in a state of rear-engagement at right-angles to the stacking direction in a locking area, they prevent lifting of the upper container only in certain areas, in such a way that the upper container may be pivoted vertically around the locking area, whereby there is provided on the container with clearance from the locking area at least one additional connecting device by which the vertically pivotable area of the upper container may be fixed releasably to the lower container, unable to be lifted, in order to obtain a container unit comprised of several containers connected to one another, and wherein the container has a bottom part with an opening, and a lid assigned to the opening of the bottom part and movable relative to the bottom part for either opening or closing the opening, and wherein the connecting device or devices has or have a coupling means mounted movably on the lid of the container and which is movable relative to the lid into a connected position in which it is simultaneously in connecting engagement with the bottom parts of the lower and upper containers to obtain a container unit, and wherein the movable coupling means of at least one connecting device is movable into a semi-connected position deviating from the connected position, in which it is in connecting engagement with the bottom part of an upper container mounted above the assigned lid, and is simultaneously disconnected from the bottom part located below the lid, so that it is possible to lift the lid together with the container mounted above the lid from the bottom part located below the lid.

2. A container assembly according to claim 1, wherein at least one foot is designed as a locking foot forming a rear-engaging element of the second engaging structure, and at least one other foot is located with clearance from the locking foot in the area of the container capable of swiveling upwards, and forms a pure support foot not used for vertical locking.

3. A container assembly according to claim 1, wherein the coupling means of at least one connecting device is in the form of a rotating locking bolt mounted rotatably on the lid, and anchoring means provided on the bottom part to interact with the rotating locking bolt are arranged in such a way that the rotating locking bolt of the lower of two stacked containers, on assuming the connected position, is in simultaneous connecting engagement with the anchoring means of the bottom parts of both containers, and wherein the rotating locking bolt in the semi-connected position altogether assumes a rotated position deviating from the connected position relative to the lid.

4. A container assembly according to claim 3, wherein the rotated position in the connected position and in the semi-connected position are rotated through 90° relative to each other.

5. A container assembly according to claim 1, wherein the coupling means is in the form of a rotating locking bolt mounted rotatably on the lid, which may be rotated into several different rotated positions, including at least a connected position, a closed position connecting the lid only with the bottom part lying below it, and an open position disconnecting the lid from the bottom part lying below it.

6. A container assembly according to claim 5, wherein the rotating locking bolt is further rotatable into a semi-connected position disconnecting the lid from the bottom part lying below it and simultaneously connecting it to the bottom part lying above it.

7. A container assembly according to claim 1, wherein the first engaging structure is located on the top side of the lid and the second engaging structure on the underside of the bottom part.

8. A container assembly, with at least one stackable container which has a first engaging structure on its top and a second engaging structure on its underside, wherein the two engaging structures are matched to one another in such a way that, when two containers are resting on top of one another, the first engaging structure lying on top of the lower container, and the second engaging structure lying below of the upper container, engage in one another in such a way that the two containers are on the one hand secured against shifting relative to one another at right-angles to the stacking direction and on the other hand, due to rear-engaging elements of the engaging structures engaging from behind at right-angles to the stacking direction, there exists between the containers a locking which prevents lifting of the upper container from the lower container at least in certain areas, wherein the first engaging structure comprises engaging recesses located on the top side of the container, and the second engaging structure comprises engaging projections located on the underside of the container, while the container has distributed on its underside several downwards projecting feet which belong to the second engaging structure and form at least partly the rear-engaging elements of the second engaging structure, and wherein the rear-engaging elements of the two engaging structures are so arranged and designed that, when they are in a state of rear-engagement at right-angles to the stacking direction in a locking area, they prevent lifting of the upper container only in certain areas, in such a way that the upper container may be pivoted vertically around the locking area, whereby there is provided on the container with clearance from the locking area at least one additional connecting device by which the vertically pivotable area of the upper container may be fixed releasably to the lower container, unable to be lifted, in order to obtain a container unit comprised of several containers connected to one another, and wherein the container has a bottom part with an opening, and a lid assigned to the opening of the bottom part and movable relative to the bottom part for either opening or closing the opening, and wherein the connecting device or devices has or have a coupling means mounted movably on the lid of the container and which is movable relative to the lid into a connected position in which it is simultaneously in connecting engagement with the bottom parts of the lower and upper containers to obtain a container unit, and wherein the coupling means of at least one connecting device is in the form of a rotating locking bolt mounted rotatably on the lid, and anchoring means provided on the bottom part to interact with the rotating locking bolt are arranged in such a way that the rotating locking bolt of the lower of two stacked containers, on assuming the connected position, is in simultaneous connecting engagement with the anchoring means of the bottom parts of both containers.

9. A container assembly according to claim 8, wherein the second engaging structure has two locking feet spaced apart and each forming a rear-engaging element.

10. A container assembly according to claim 9, wherein, between the two locking feet, there extends a locking strip which, in the stacked condition of two containers is also in locking engagement with the rear-engaging elements of the first engaging structure.

11. A container assembly according to claim 8, wherein the locking foot or feet has or have a wedge-shaped profiled rear-engaging section for engaging behind the first engaging structure.

12. A container assembly according to claim 11, wherein the wedge-shaped profiled rear-engaging section faces away from the support foot or feet.

13. A container assembly according to claim 8, wherein the first engaging structure has for interaction with the locking feet at least one locking engaging recess with a relief-cut cross-section, on the edge of which is provided a rear-engaging projection which may be engaged from the rear by a locking foot dipping into the locking engaging recess.

14. A container assembly according to claim 8, wherein the side wall of at least one engaging recess serving to accommodate a support foot is designed at least partly as an inclined sliding surface to assist the dipping-in of the support foot.

15. A container assembly according to claim 8, wherein at least one engaging recess of the first engaging structure is designed to accommodate simultaneously two of the spaced apart locking feet acting as rear-engaging elements.

16. A container assembly according to claim 8, wherein there is provided on the top side of the container a carrying handle which may be swiveled relative to the body of the container and which, in an out-of-use position, may be swiveled into a locating recess on the top side of the container, whereby this locating recess is formed directly by an engaging recess of the first engaging structure.

17. A container assembly according to claim 16, wherein the locating recess is formed directly by a locking engaging recess forming the rear-engaging elements of the first engaging structure.

18. A container assembly according to claim 8, wherein at least one engaging recess forming the rear-engaging elements of the first engaging structure simultaneously forms a handgrip recess which may be used for carrying the container.

19. A container assembly according to claim 8, wherein the movable coupling means of at least one connecting device is movable into a closed position deviating from the connected position, in which it is disconnected from an upper container mounted over the assigned lid and is simultaneously in connecting engagement with the bottom part located below the lid in such a way that the lid is locked in a covering position relative to this bottom part which closes the opening of the bottom part.

20. A container assembly according to claim 8, wherein several connecting devices are provided, distributed at several points along the periphery of the container, and operable independently of one another.

21. A container assembly according to claim 8, wherein at least one connecting device has, located on the bottom part and spaced apart in the stacking direction of the container, first and second anchoring means, of which the first anchoring means are placed closer to the lid than the second anchoring means in such a way that the rotating locking bolt of the lower of two stacked containers, on assuming the connected position, is in connecting engagement on the one hand with the first anchoring means provided on the bottom part of the lower container, and on the other hand with the second anchoring means provided on the bottom part of the upper container.

22. A container assembly according to claim 8, wherein the rotating locking bolt, on assuming the connected position, has locking structures which are in connecting engagement with the anchoring means of two stacked containers.

23. A container assembly according to claim 22, wherein the anchoring means are in the form of projections, and the locking structures are portions of in particular slot-like recesses, or vice-versa.

24. A container assembly according to claim 22, wherein both the anchoring means and also the locking structures are curved, with bow centers lying on the rotation axis of the rotating locking bolt.

25. A container assembly according to claim 23, wherein the recesses are slot-like.

26. A container assembly according to claim 8, wherein the connecting device or devices is or are located on an end face of the container oriented at right-angles to the stacking direction of the container, whereby the rotating locking bolt is rotatable relative to a rotation axis at right-angles to this end face.

27. A container assembly according to claim 8, wherein the lid is mounted pivotably on the bottom part with clearance from the front end face of the container in such a way that, with the coupling means of at least one connecting device moved in to an open position, it may be swiveled upwards in the front section relative to the bottom part.

28. A container assembly according to claim 27, wherein it has only a single connecting device, which is located in the center of the width of a front end face of the container.

29. A container assembly according to claim 8, wherein it has at least two containers which may be stacked one on top of the other and connected releasably together to form a container unit.

30. A container assembly according to claim 8, wherein, upon cooperation with an engaging recess of the first engaging structure, the pure support foot provides support at right-angles to the stacking direction for preventing a relative movement of the containers in a direction at right angles to the stacking direction, while not locking the containers in the stacking direction.

31. A container assembly, with at least one stackable container which has a first engaging structure on its top and a second engaging structure on its underside, wherein the two engaging structures are matched to one another in such a way that, when two containers are resting on top of one another, the first engaging structure lying on top of the lower container, and the second engaging structure lying below of the upper container, engage in one another in such a way that the two containers are on the one hand secured against shifting relative to one another at right-angles to the stacking direction and on the other hand, due to rear-engaging elements of the engaging structures engaging from behind at right-angles to the stacking direction, there exists between the containers a locking which prevents lifting of the upper container from the lower container at least in certain areas, wherein the first engaging structure comprises engaging recesses located on the top side of the container, and the second engaging structure comprises engaging projections located on the underside of the container, while the container has distributed on its underside several downwards projecting feet which belong to the second engaging structure and form at least partly the rear-engaging elements of the second engaging structure, and wherein the rear-engaging elements of the two engaging structures are so arranged and designed that, when they are in a state of rear-engagement at right-angles to the stacking direction in a locking area, they prevent lifting of the upper container only in certain areas, in such a way that the upper container may be pivoted vertically around the locking area, whereby there is provided on the container with clearance from the locking area at least one additional connecting device by which the vertically pivotable area of the upper container may be fixed releasably to the lower container, unable to be lifted, in order to obtain a container unit comprised of several containers connected to one another, and wherein the container has a bottom part with an opening, and a lid assigned to the opening of the bottom part and movable relative to the bottom part for either opening or closing the opening, and wherein the connecting device or devices has or have a coupling means mounted movably on the lid of the container and which is movable relative to the lid into a connected position in which it is simultaneously in connecting engagement with the bottom parts of the lower and upper containers to obtain a container unit, and wherein the movable coupling means of at least one connecting device is movable into a closed position deviating from the connected position, in which it is disconnected from an upper container mounted over the assigned lid and is simultaneously in connecting engagement with the bottom part located below the lid in such a way that the lid is locked in a covering position relative to this bottom part which closes the opening of the bottom part, and wherein the coupling means of at least one connecting device is in the form of a rotating locking bolt mounted rotatably on the lid, and anchoring means provided on the bottom part to interact with the rotating locking bolt are arranged in such a way that the rotating locking bolt of the lower of two stacked containers, on assuming the connected position, is in simultaneous connecting engagement with the anchoring means of the bottom parts of both containers, and wherein, in the closed position, the rotating locking bolt assumes a rotated position relative to the lid which deviates from the connected position.

32. A container assembly according to claim 31, wherein the rotating locking bolt has, offset in its direction of rotation, locking structures which in the connected position and in the closed position are alternately in connecting engagement with the same anchoring means located on the bottom part.

33. A container assembly according to claim 32, wherein the locking structures are so offset relative to one another in the direction of rotation of the rotating locking bolt that the rotating locking bolt may be rotated into an open position in which the anchoring means fitted to the bottom part and cooperating with the rotating locking bolt in the connected position and in the closed position lie between the locking structures, thereby cancelling out the connecting engagement, to allow raising of the lid from the bottom part to open the opening of the bottom part.

* * * * *